US005765254A

United States Patent [19]

O'Halloran

[11] Patent Number: 5,765,254

[45] Date of Patent: Jun. 16, 1998

[54] TOOTHBRUSH WITH FLEXIBLE NECK

[75] Inventor: James O'Halloran, Kutztown, Pa.

[73] Assignee: Radius Inc., Kutztown, Pa.

[21] Appl. No.: 563,994

[22] Filed: Nov. 29, 1995

[51] Int. Cl.[6] ..... A46B 9/04

[52] U.S. Cl. ..... 15/167.1; 15/143.1; 15/172

[58] Field of Search ..... 15/143.1, 144.1, 15/167.1, 172; 264/243, 259, 328.1

[56] References Cited

U.S. PATENT DOCUMENTS

| | | | |
|---|---|---|---|
| 758,764 | 5/1904 | Macleod . | |
| 759,490 | 5/1904 | Yates | 15/143.1 |
| 1,369,966 | 3/1921 | Cosens et al. . | |
| 1,796,001 | 3/1931 | Church . | |
| 2,028,011 | 1/1936 | Raymond . | |
| 3,120,670 | 2/1964 | Amodeo . | |
| 4,488,328 | 12/1984 | Hyman | 15/144.1 |
| 4,520,526 | 6/1985 | Peters . | |
| 4,575,894 | 3/1986 | Stevens et al. | 15/172 |
| 4,829,621 | 5/1989 | Phenegar . | |
| 5,052,071 | 10/1991 | Halm . | |
| 5,054,154 | 10/1991 | Schiffer et al. | 15/172 |
| 5,105,499 | 4/1992 | Dirksing | 15/172 |
| 5,323,504 | 6/1994 | McCusker . | |

FOREIGN PATENT DOCUMENTS

| | | | |
|---|---|---|---|
| WO 8803772 | 6/1988 | European Pat. Off. . | |
| 2050156 | 1/1981 | United Kingdom | 15/143.1 |
| WO 88/06417 | 9/1988 | WIPO | 15/172 |

*Primary Examiner*—David Scherbel
*Assistant Examiner*—Terrence Till
*Attorney, Agent, or Firm*—Darby & Darby

[57] ABSTRACT

An improved toothbrush is provided with a flexible neck to avoid damage to teeth and gums due to excessive brushing pressure. The toothbrush has a bush head made of a semi-rigid material to adequately support bristles, and a handle and neck made of an elastic material. The elastic material of the handle is comfortable in the users hands. The elastic material of the neck provides the flexibility to avoid damage due to excessive brushing pressure exerted by the user on the handle. The flexible neck is reinforced by semi-rigid arms formed integral with and ending from the semi-rigid material of the brush head. The reinforcing arms are connected by a web with spaced-apart openings. The web openings are provided to receive a portion of the elastic material of the neck to further secure the neck and the handle to the brush head.

22 Claims, 2 Drawing Sheets

TOOTHBRUSH WITH FLEXIBLE NECK

FIELD OF THE INVENTION

This invention generally relates to toothbrushes, and more particularly, to toothbrushes having a head portion that is flexibly connected to a soft, comfortable handle and methods of manufacturing such flexible toothbrushes.

BACKGROUND OF THE INVENTION

Toothbrushes with soft handles are known in the prior art. The soft handle provides a comfortable grip zone which feels good in the hand of the user. However, elastic materials such as rubber which can provide a soft, comfortable handle or a flexible neck between the handle and the brush head will not adequately support and retain bristles in the brush head. Also, elastic materials, particularly of softer varieties, substantially reduce the resistance of the toothbrush to bending forces particularly in the neck of the toothbrush. As a result, a toothbrush made of an elastic material such as rubber may fail to transmit the forces necessary to effectively clean teeth.

Providing controlled flexibility to the neck portion of a toothbrush with respect to its supporting handle is well known in the prior art and several examples of such toothbrushes are commercially available. One purpose of providing toothbrush neck flexibility is to effectively limit the amount of force the user may apply to his teeth. It has been recognized that brushing one's teeth using excessive force, in an aggressive manner, can irritate and otherwise damage teeth and the surrounding gums. Abrasions characterized by "V" shaped indentations may occur at the cementum enamel junction just below the gumline as the result of using excessive force. In theory, by providing a flexible neck toothbrush, the amount of force transmitted to the teeth and gums is controlled and limited to a safe level without reducing the overall efficiency of the brushing action in cleaning teeth.

To effectively and efficiently clean the surfaces of one's teeth, the ends of the bristles should evenly contact the teeth with a prescribed amount of force. The amount of force required depends on the type, hardness, and cut of the bristles used, as well as the particular shape and condition of the person's teeth. Excessive force applied to the bristles during brushing can reduce the cleaning efficiency by distorting the bristles which forces the end of each bristle away from the surface of the teeth. Also, if the excessive force is repeated frequently, the bristles will eventually distort permanently and the toothbrush will require replacement.

Many of the prior art flexible toothbrushes concentrate on providing flexibility to the head portion with respect to the neck (or intermediate) portion of the toothbrush. Although this construction automatically limits the amount of force a user may apply to his teeth, the limit is easily overcome by the user due to the leverage advantage offered by the combined lengths of the handle and the neck portion. The relatively short head is quick to distort to its maximum point of angular displacement with respect to the neck portion as force is applied during normal brushing. This premature distortion of the head tends to lift the bristles of a forward portion of the head from the surface of the teeth, and concurrently forces the bristles of a rearward portion of the head into distortion against the teeth, reducing the overall effective brushing area of the head. The user will have a tendency to compensate for the pivoting head movement by further pivoting the handle (and neck) to force the forward portion of the head back towards the teeth. Attempts to compensate may only further distort the rearward bristles and ultimately cause the transfer of an excessive and undesirable amount of force to the surface of the teeth and surrounding gums.

It is therefore an object of the invention to provide a toothbrush which overcomes the deficiencies of the prior art.

It is another object of the invention to provide a flexible toothbrush which is simple in construction and inexpensive to manufacture.

It is another object of the invention to provide a flexible toothbrush which effectively restricts the amount of force applied to a user's teeth while maintaining even contact between the bristles and the surface of the teeth.

SUMMARY OF THE INVENTION

A toothbrush comprises a head, a handle and an intermediate member hereinafter referred to as the "neck". The head is formed of a material which can adequately support bristles and has a front face and a rear face. The front face is adapted to support a plurality of bristles so that the bristles are positioned generally perpendicular to the front face. The handle is longitudinally positioned about a handle axis. The handle has an upper end, and may be constructed of a soft, "elastic" material. The neck is located generally along the handle axis between the head and the handle and includes a lower end and an upper end. The lower end of the neck is attached to the upper end of the handle while the upper end of the neck is attached to the rear face of the head. The neck is constructed of an elastic material so that both the neck and the head may pivot with respect to the handle. The neck is selectively stiffened with a reinforcing member which is integrally supported by the head and may be formed of the same material as the head.

BRIEF DESCRIPTION OF THE DRAWINGS

To fully understand the invention, reference is made to the following description taken in connection with the accompanying drawings, in which.

DETAILED DESCRIPTION OF THE PREFERRED EMBODIMENT

Figure 1:
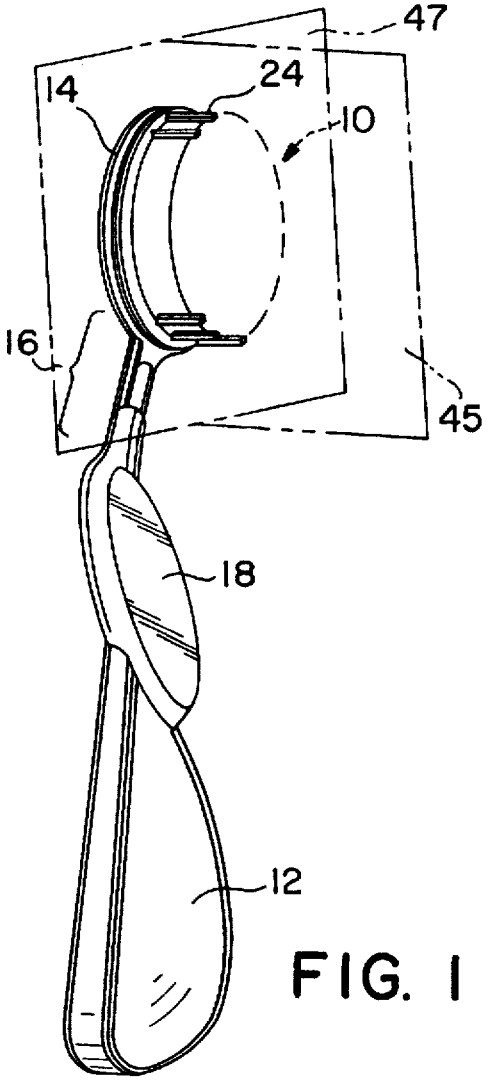
FIG. 1 is a perspective view of the toothbrush, in accordance with the invention.
Figure 2:
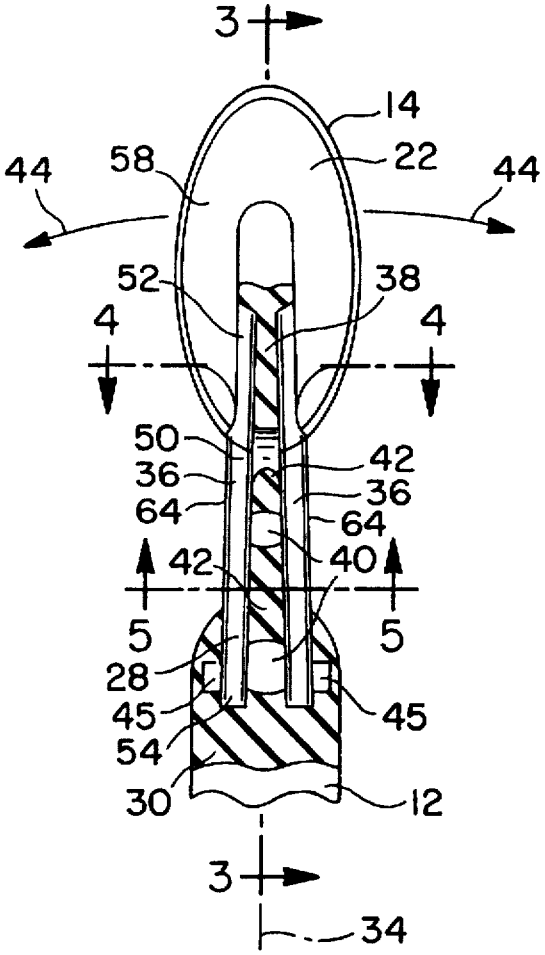
FIG. 2 is sectional partial rear view showing construction details of an intermediate member and a reinforcement member, in accordance with the invention.
Figure 3:
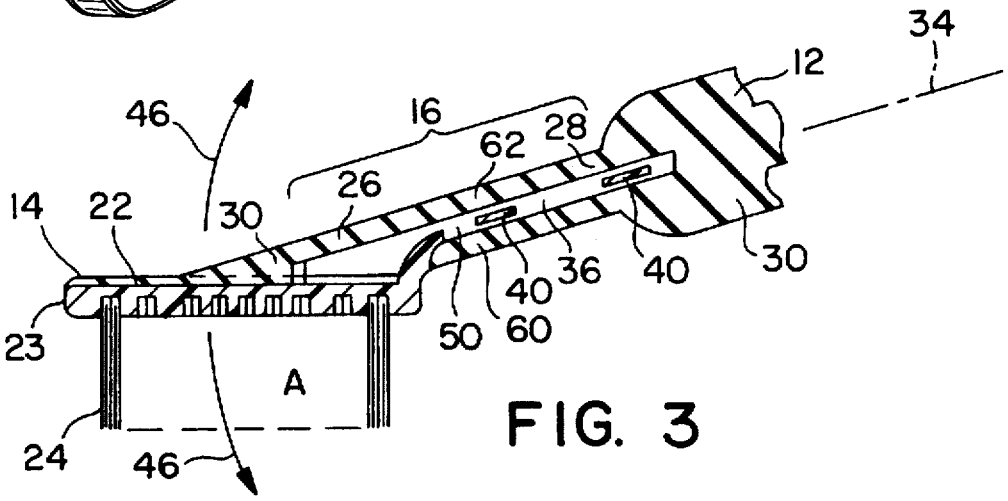
FIG. 3 is a sectional view of the toothbrush, in accordance with the invention, taken along the line 3—3 of FIG. 2.

Referring to FIGS. 1, 2 and 3, a toothbrush 10, in accordance with the invention is shown having a handle 12, a head 14 and an intermediate member (hereinafter referred to as the "neck") 16. The handle 12 preferably includes an ergonomic shape to be comfortably and firmly gripped by a user's hand. The handle 12 may include a cup-like depression 18 for receiving a thumb of the user for added control. The head 14 is preferably flat in cross-section, as viewed in FIG. 4, for example, and includes a front face 20, a parallel rear face 22 and a side wall 23 connecting the front face 20 and the rear face 22. As is appreciated by those skilled in the art, a plurality of bristles 24 are attached, generally perpendicularly, to the front face 20 in a conventional manner. The front face 20 defines a lateral plane and a perpendicular transverse plane which are used hereinafter in describing the angular displacement of the elements of the invention.

The neck 16 attaches the head 14 to an upper portion of the handle 12. As shown in FIGS. 2 and 3, the neck 16 is an elongated extension of the handle 12 and includes an upper end 26 and a lower end 28. In the preferred embodiment, the neck is supported by and formed integrally with the handle 12 from an elastic material 30 such as rubber. Any suitable elastic material may be used. The neck 16 and the handle 12 alternatively may each be made of a different grade of the same elastic material, or from different elastic materials, or the neck 16 may be formed of an elastic material, while the handle is made of a substantially inelastic material, such as a hard plastic. In such a construction, the elastic material of the neck would be bonded or otherwise attached to the selected handle material in a conventional manner.

As shown in FIGS. 2, 3, 4 and 5, the reinforcement member 50 is elongated and includes an upper end 52 and a lower end 54. The upper end 52 is preferably formed integral to the rear face 22 of the head 14 (or otherwise attached thereto). The upper end 52 is preferably attached to the rear face 22 along an extended portion to provide reinforcement to the head 14 and restrict independent pivotal movement or angular displacement between the upper end 52 of the neck 16 and the head 14. The lower end 54 is embedded in the elastic material 30 of the handle 12.

The reinforcement member 50 preferably includes two coplanar arms 36 which are angularly displaced from each other about a connecting point 38 located on the rear face 22 of the head 14 (see FIG. 2). The reinforcement member 50 is generally disposed along a handle axis 34, as shown in FIGS. 2 and 3. The two arms 36 are connected to each other along a handle axis 34 by a web 40. The web 40 preferably includes spaced anchor openings 42, which, as described below, are adapted to receive the elastic material 30 to further secure the reinforcement member 50 to the neck 16 and to the handle 12. The reinforcement member 50 may be further secured to the neck 16 and the handle 12 by outwardly projecting anchor tabs 45.

The orientation of the two arms 36, the web 40 and the anchor tabs 45 discourage lateral movement of the head 14 in the direction depicted by the arrows 44 of FIG. 2, within the lateral plane. Transverse angular displacement of the head 14 with respect to the handle 12, in the direction depicted by the arrows 46 of FIG. 3 is restricted by the resilient nature of the material used to form the reinforcement member 50. Anchor tabs 45 discourage the lower end 54 of the reinforcement member 50 from moving in the direction of the head 14 when lateral or transverse forces are applied to the head. The reinforcement member 50 and its integrally formed head 14 are preferably made from an appropriate plastic, such a polypropylene. The specific material of the reinforcement member 50 and the dimensions of the arms 36 are dependent on the degree of resiliency desired.

Figure 4:
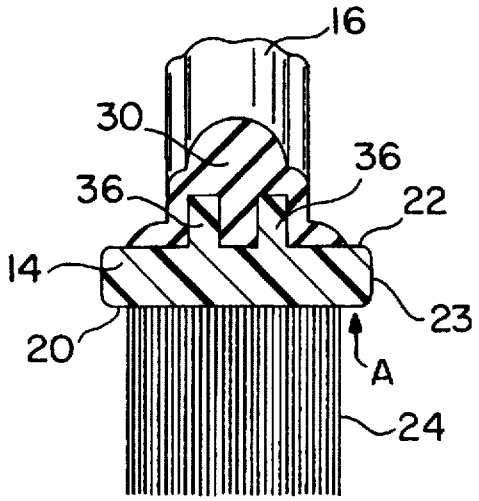
FIG. 4 is a sectional view of the toothbrush, in accordance with the invention, taken along the line 2—2 of FIG. 2.
Figure 5:
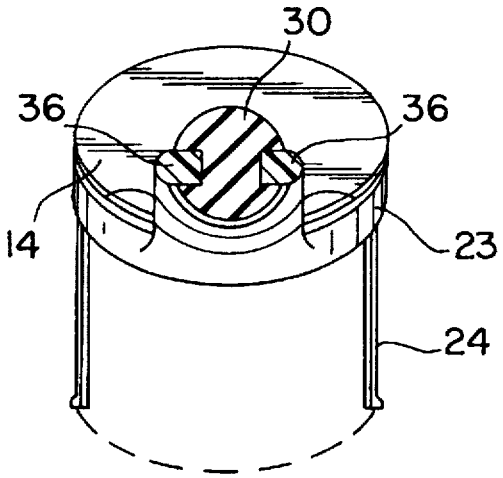
FIG. 5 is a sectional view of the toothbrush, in accordance with the invention, taken along the line 5—5 of FIG. 2.

It is preferred that a front surface 60 and a rear surface 62 of the neck 16 and the rear face 22 of the head 14 be covered with a layer (of predetermined thickness) of the elastic material 30, as shown in FIGS. 3, 4 and 5. Lateral surfaces 64 of the arm 36, and the front face 20 and sidewall 23 of the head 16 are not covered with elastic material 30 and remain exposed.

To manufacture the toothbrush 10, first the head 14 and the reinforcement member 50 are integrally molded in a conventional manner, such as by injection molding, as is well known in the art, to form a head insert 58. The head insert 58 is then placed into a cavity mold (not shown) so that all surfaces of head insert 58 are exposed to the mold cavity except the front face 20 and the sidewall 23 of the head 16 and the lateral surfaces 64 of the arms 34. An appropriate elastic material is injected into the cavity mold forming the handle 12 and the neck 16, forcing the elastic material 30 into the anchor openings 42, and bonding to all surfaces of the head 14 and the reinforcement member 50 exposed to the mold cavity prior to curing. The mold is opened and the toothbrush 10 is complete with the exception of the bristles which may be added later using any conventional method.

In use, the toothbrush 10 is forced against the teeth which causes transverse displacement in the transverse plane 45 (rearward) of the head 14 in the direction of the arrows 46 (in FIG. 3), flexing the neck 16 in a gradual arc along the handle axis 34. The elongated neck 16 made of an elastic material 30 provides a high degree of flexibility. The flexibility is selectively determined and controlled by the material and dimensions of the arms 34 of reinforcement 50. The gradual flexing of the reinforcement member 50 with respect to the handle 12 helps keep the bristle tips evenly disposed against the surface of the teeth regardless of the degree of force applied transversely through the handle during brushing.

Side to side, or lateral angular displacement in the lateral plane 47 (see arrows 44 in FIG. 2) is discouraged to help keep the bristles substantially perpendicular to the surface of the teeth and to prevent twisting of the head 14 and neck 16 along the handle axis 34. Lateral angular displacement is also discouraged so that the brush may transmit the forces necessary to effectively clean the teeth.

Other embodiments will occur to those skilled in the art and are within the scope of the following claims:

What is claimed is:

1. A toothbrush comprising, a handle made of a first elastic material having an upper end, said handle positioned about a handle axis;

a head having a front face and a rear face, said front face defining a lateral plane and a transverse plane perpendicular to said lateral plane, said transverse plane aligned with said handle axis, said front face adapted to support a plurality of bristles, said bristles being positioned generally perpendicular to said front face;

an intermediate member made of a second elastic material, said intermediate member located generally along said handle axis between said head and said handle, said intermediate member including a lower end and an upper end, said lower end of said intermediate member being supported on said upper end of said handle, said upper end of said intermediate member being supported on said head, so that said intermediate member and said head may pivot with respect to said handle; and a reinforcement member located generally along said handle axis between said head and said handle, said reinforcement member supported by and formed integral with said head and said reinforcement member contiguous with said intermediate member.

2. The toothbrush according to claim 1, wherein said intermediate member is formed integral with said handle.

3. The toothbrush according to claim 1, wherein said reinforcement member includes two adjacent coplanar arms generally parallel to said handle axis, said arms being arranged to permit a first maximum predetermined angular displacement of said head within said transverse plane from a rest position and with respect to said handle.

4. The toothbrush according to claim 3, wherein said arms are connected to each other at selected points between said head and said handle, defining anchor openings for receiving at least a portion of said second elastic material.

5. The toothbrush according to claim 4, wherein said second elastic material extends from said handle and covers at least a portion of said reinforcing member through said anchor opening.

6. The toothbrush according to claim 4, wherein said second elastic material is rubber.

7. The toothbrush according to claim 4, wherein said second elastic material further covers at least a portion of said arms and is secured to said arms through said anchor openings.

8. The toothbrush according to claim 3, wherein said arms further permit a second maximum predetermined angular displacement of said head from said rest position within said lateral plane and with respect to said handle.

9. The toothbrush according to claim 1, wherein said reinforcement member further includes an anchor means for anchoring said reinforcement member in said second elastic material.

10. The toothbrush according to claim 9, wherein said anchor means comprises an anchor opening for receiving at least a portion of said second elastic material.

11. The toothbrush according to claim 1, wherein said second elastic material is rubber.

12. The toothbrush according to claim 1, wherein said second elastic material covers at least a portion of said reinforcing member and at least a portion of said head.

13. The toothbrush according to claim 1, wherein said first elastic material and said second elastic material are the same material.

14. A toothbrush comprising, a handle having an upper end, said handle positioned about a handle axis;

a head having a front face and a rear face, said front face defining a lateral plane and a transverse plane perpendicular to said lateral plane, said transverse plane aligned with said handle axis, said front face adapted to support a plurality of bristles, said bristles being positioned generally perpendicular to said front face;

an intermediate member made of a first elastic material, said intermediate member located generally along said handle axis between said head and said handle, said intermediate member including a lower end and an upper end, said lower end of said intermediate member being supported on said upper end of said handle, said upper end of said intermediate member being supported on said head, so that said intermediate member and said head may pivot with respect to said handle; and a reinforcement member located generally along said handle axis between said head and said handle, said reinforcement member supported by and formed integral with said head, said reinforcement member contiguous with said intermediate member, and said reinforcement member having an anchor means for anchoring said reinforcement member in said first elastic material.

15. The toothbrush according to claim 14, wherein said intermediate member is formed integral with said handle.

16. The toothbrush according to claim 14, wherein said reinforcement member includes two adjacent coplanar arms generally parallel to said handle axis, said arms being arranged to permit a first maximum predetermined angular displacement of said head within said transverse plane from a rest position and with respect to said handle.

17. The toothbrush according to claim 16, wherein said arms are connected to each other at selected points between said head and said handle, defining anchor openings for receiving at least a portion of said first elastic material.

18. The toothbrush according to claim 17, wherein said first elastic material further covers said arms and is secured to said arms through said anchor openings.

19. The toothbrush according to claim 17, wherein said first elastic material extends from said handle and covers at least a portion of said reinforcing member through said anchor opening.

20. The toothbrush according to claim 16, wherein said arms further permit a second maximum predetermined angular displacement of said head from said rest position within said lateral plane and with respect to said handle.

21. The toothbrush according to claim 14, wherein said anchor means comprises an anchor opening for receiving at least a portion of said first elastic material.

22. The toothbrush according to claim 14, wherein said first elastic material covers at least a portion of said reinforcing member and at least a portion of said head.

* * * * *